United States Patent [19]

Henderson

[11] Patent Number: 4,568,302

[45] Date of Patent: Feb. 4, 1986

[54] MANUALLY ACTUABLE AERATING DEVICE FOR DOLL'S SPA

[75] Inventor: Richard E. Henderson, Costa Mesa, Calif.

[73] Assignee: Mattel, Inc., Hawthorne, Calif.

[21] Appl. No.: 565,484

[22] Filed: Dec. 27, 1983

[51] Int. Cl.[4] ..... A63H 3/52

[52] U.S. Cl. ..... 446/186; 446/197; 446/472

[58] Field of Search ..... 446/176, 197, 296, 186, 446/472; 417/540; 4/543

[56] References Cited

U.S. PATENT DOCUMENTS

| | | | |
|---|---|---|---|
| 17,726 | 7/1857 | Clark | 417/540 |
| 1,034,919 | 8/1912 | Leuschner | 4/543 |
| 2,119,133 | 5/1938 | Hogan | 417/540 X |
| 2,734,462 | 2/1956 | Schaefer | 417/540 X |
| 2,970,749 | 2/1961 | Montague | 230/169 |
| 3,251,071 | 5/1966 | Wood | 4/543 |
| 3,998,001 | 12/1976 | Meyer et al. | 46/8 |
| 4,159,705 | 7/1979 | Jacoby | 446/176 X |

*Primary Examiner*—F. Barry Shay

*Attorney, Agent, or Firm*—Ronald M. Goldman; Melvin A. Klein

[57] ABSTRACT

A toy spa (10) is provided with water (56) and an aerating manifold (18) in the base (16) of the spa. Pressurized air is provided to the manifold via a bellows pump and passes through the water from openings (20) in the manifold. To reduce the surge effect of the bellows pump an expandable reservoir means (40) is provided between the bellows pump and the aerating manifold (18). Air is pumped from the bellows pump directly into the expandable reservoir through a one way valve (32) moved by the pressurized air. Air exits from the expanded reservoir via a restricted opening (44) which enables the pressurized air to be first stored within the expandable reservoir and to then be delivered to the manifold in a continuous, even manner.

5 Claims, 5 Drawing Figures

MANUALLY ACTUABLE AERATING DEVICE FOR DOLL'S SPA

TECHNICAL FIELD

This invention relates to accessories for use by a child when playing with dolls, and more particularly to a toy spa for use with dolls.

BACKGROUND ART

Many accessory devices for use by children when playing with dolls are known. One such type of accessory is described in U.S. Pat. No. 3,988,001, entitled "Doll Shower and Bubble Bath Device". The disclosed device includes a bath tub having an upstanding shower with a spray nozzle and a surrounding shower curtain. The base of the tub has a number of openings provided with air through a manifold from a bellows pump actuated by a pumping handle on the exterior of the tub.

Other known patents, such as U.S. Pat. Nos. 17,726 and 2,970,749, disclose expansible devices for use in pumping fluids. In each patent, a substantially constant and controlled flow of fluid, is provided by the action of an expandable bag, or sack.

However, none of the known prior art discloses a play spa for use by a child in playing with dolls, in which the spa is aerated by a manually actuable pump, and which includes a reservoir or storage means between the pump and the spa, to deliver a continuous and even flow of air to the toy spa.

DISCLOSURE OF THE INVENTION

In accordance with the present invention, a manually actuable water aerating device in combination with a top spa for use in playing with dolls is disclosed. The device comprises a housing supporting a spa with a fluid held therein. The base of the spa includes an aerating manifold sealingly connected thereto with a plurality of holes in the manifold. A bellows pump is connected by a one-way valve to the aerating manifold and, a reservoir means is included between the pump and the manifold whereby air pumped from the bellows is first captured in the reservoir and then fed to the aerating manifold, in a controlled manner, to equalize the air flow to the aerating manifold and thereby reduce the surge effect of the bellows pump.

Further objects, features and advantages of the invention will become apparent upon a reading of the specification, when taken in conjunction with the attached drawings, in which like reference numerals refer to like elements in the several views.

BEST MODE FOR CARRYING OUT THE INVENTION

Figure 1:
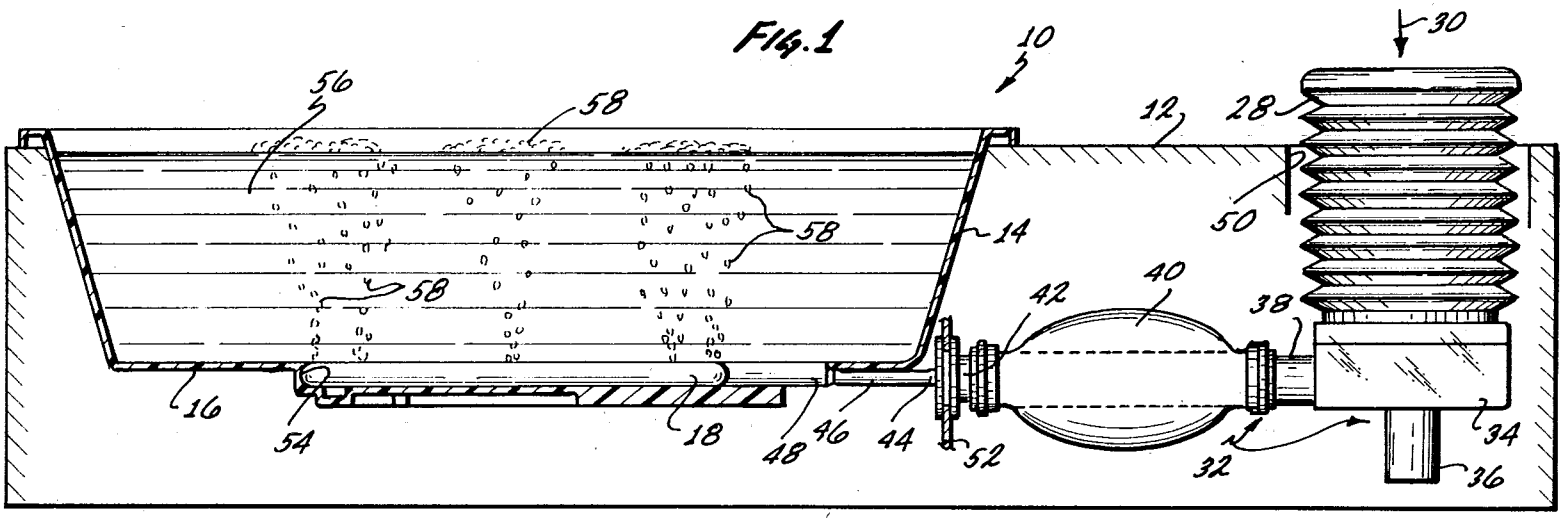
FIG. 1 is a partial sectional view showing the spa and pumping arrangement to aerate the toy spa of the present invention.
Figure 5:
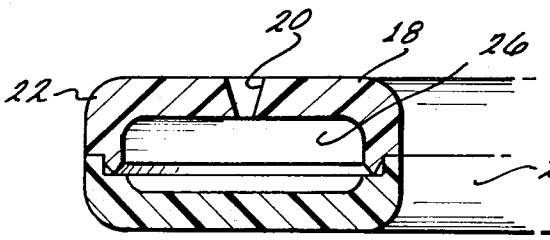
FIG. 5 is a further cross-sectional view of the aerating manifold taken along line 5—5 of FIG. 2.
Figure 4:
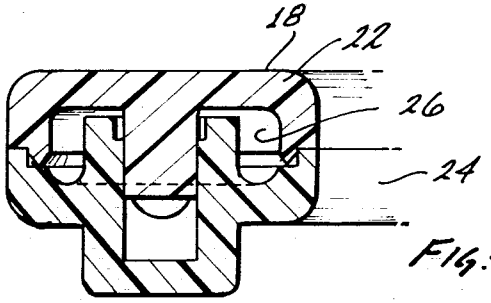
FIG. 4 is a cross-sectional view of the aerating manifold taken along line 4—4 of FIG. 2.
Figures 2, 3:
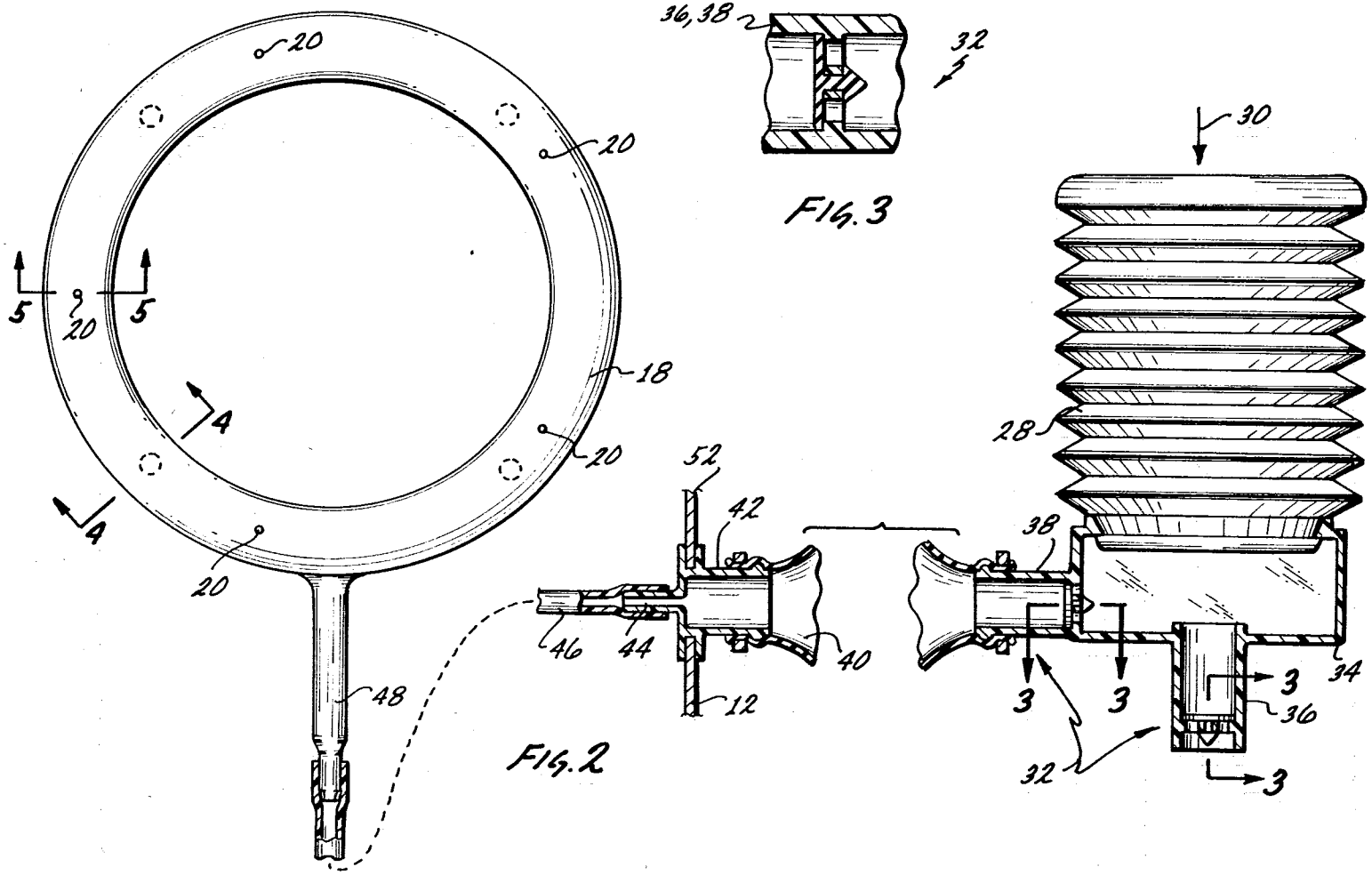
FIG. 2 is a schematic view of the bellows pump, inflatable bladder, and aerating manifold of the present invention.
FIG. 3 is a cross-sectional view taken along lines 3—3 of FIG. 2, showing the check valves feeding air into and out from the interior chamber of the bellows pump.

Referring now to the drawings, and in particular FIGS. 1 and 2, there shown is a toy spa 10, for use with dolls, supported within a housing 12, made to simulate a deck, or the like, surrounding the spa. The spa 10 is preferably circular, with side 14, which may slope, as shown, and a base 26, which is preferably flat. An aerating manifold 18, which may be of any desired shape, is attached to or placed in the spa. This manifold is also preferably circular in shape, with a plurality is also preferably circular in shape, with a plurality of holes 20 formed in the top surface thereof. The manifold may be made in any desired manner, and is shown as including upper and lower portions 22, 24 sealingly held together around a hollow interior 26, which varies in cross-section so as to allow pressurized fluid entering the manifold to expand and exit through the holes 20, in a substantially uniform manner.

Pressurized fluid, such as air is provided to the manifold from a bellows pump 28 when a force, such as the pressure of a child's hand, is applied in the direction of the arrow 30. A plurality of check valves 32 are provided to allow atmospheric air to enter the hollow interior chamber 34 of the pump; to be pressurized, and to then be fed into the aerating manifold 18. The check valves 32 may either flex, or be slideably mounted within holding means held in conduits 36, 38. Conduit 36 allows air at atmospheric pressure to be drawn into the hollow interior chamber through the check valve 32 contained therein, while conduit 38 allows pressurized air, from the hollow interior chamber 34 to be fed, through check valve 32, into an expandable reservoir or bladder 40. The air from reservoir 40 passes or exits through another conduit 42 and into a narrow or constricted opening 44. After passage through opening 44, the air is fed into a flexible tube 46 and then into a feeding conduit 48 connected to the aerating manifold 18. The reservoir 40 formed of an expansible elastomeric material such as rubber, is shown in solid line in FIG. 1 in the expanded, pressurized position and in broken lines in the unpressurized or unexpanded position.

The bellows pump 28 may be held or secured within an opening 50 in the housing 12 with the conduit 42 from the bladder 40 to the aerating manifold secured within the housing by means of a brace or the like 52, held in or formed integrally with the housing. In addition, the aerating manifold 18 may be sealingly secured to the lower portion of the base 16 of the spa 10, around an opening 54 formed within the base. As an alternative arrangement, the aerating manifold may be placed within the spa, resting on the base 16 which would be solid, with the feeding conduit 48 or tube 46 sealingly passing through an opening (not shown) formed in the side wall 14.

In operation, the spa 10 is filled with a fluid 56, such as water, to any desired level. One or more dolls (not shown) may then be placed within the spa in any desired play position. Bellows pump 28 is actuated by a child pressing in the direction of arrow 30. Upon actuation of the bellows pump 28, air contained within the hollow chamber 34 will be pressurized until it is forced past check valve 32 and out into the conduit 38. The pressurized air will enter the expandable reservoir or bladder 40 and inflate the same, due to the restricted exit 44. Continuous actuation of the bellows pump 28 by a child will pump the bladder 40 to the desired or maximum expansion possible. The pressurized air in the expanded bladder passes through the conduit 42 and exits, through the restricted opening 44, for passage through the flexible tube 46, into the connecting conduit 48 and then into the manifold 18. Once in the manifold 18, the air will expand and exit through the openings 20 to form air bubbles 58 which will rise upwardly through the water 56 thereby providing the aerating effect of a simulated spa or the like.

Due to the expansion of the elastomeric bladder 40, and the restriction of the air flow through the small opening 44, air under pressure is stored within the expanded bladder to allow for the continuous, even aeration of the water through the openings 20. Therefore, the bladder aids in reducing or eliminating the surge effect normally caused by the actuation of a bellows pump system, directly connected to a manifold. This increases the play value of the spa to a child, and allows the child to pump up the bladder, and then play with dolls in the spa during aeration, without having to continuously operate the pump.

While there has been shown and described a preferred embodiment of the invention, it is to be understood that there are other adaptations or modifications that may be made within the spirit and scope of the invention, as set forth in the attached claims.

I claim:

1. A manually actuable aerating device in combination with a toy spa comprising:

a housing having first and second openings and a deck therebetween;

a toy spa received in said first opening with a base and a side for holding a liquid therein, and adapted to hold one or more dolls during play supported within said housing;

an aerating manifold in the base and having a plurality of holes contained therein;

a manually actuable bellows pump received in the second opening having a plurality of one-way valves connected thereto; and a reservoir means mounted in said housing beneath said deck between the bellows pump and the manifold, means connecting said manifold, reservoir means and pump for the passage of gas from said pump through said reservoir means and manifold, the reservoir means storing compressed gas therein upon manual actuation of the bellows pump by a child user, whereby the aerating manifold is supplied with a continous supply of pressurized gas from the reservoir means to equalize the streams of gas exiting from the openings in the manifold into the liquid held in the toy spa to thereby provide the effect of a simulated spa for any dolls therein.

2. The toy spa of claim 1 wherein the reservoir means is an expandable elastomeric bladder which inflates upon fluid pressure being applied thereto from the bellows pump.

3. The toy spa of claim 2 wherein the fluid exiting from the expandable bladder passes through a restricted opening formed between the bladder and the aerating manifold.

4. The toy spa of claim 3 wherein the toy spa includes an opening in its base, and the aerating manifold is sealingly connected to the base at the opening with the plurality of holes in the manifold in alignment with the opening.

5. A manually actuable water aerating device in combination with a toy spa comprising;

a housing having first and second openings and a deck therebetween;

a toy spa received in said first opening having a substantially flat base and a slanted side holding water therein supported in said housing and adapted to hold one or more dolls during play, the base having an enlarged opening formed therein;

an aerating manifold sealingly connected to the enlarged opening, the manifold having a plurality of holes formed therein, and in alignment with the enlarged opening in the base;

a manually actuable bellows pump received in said second opening including a plurality of one way valves, one of the valves connected to an exit conduit whereby air pressurized in the pump passes through the one valve to a further conduit; and an elastomeric, expandable bladder mounted in said housing, means establishing a flow path for air from said pump through said bladder and manifold, the bladder being inflated by the manual action of the bellows pump by a child user, and the manifold being supplied with a continous supply of air under pressure from the expanded bladder via a restricted opening formed between the bladder and the manifold, to thereby equalize the flow of air exiting from the holes in the manifold to aerate the water held in the toy spa to thereby provide the effect of a simulated spa for any dolls therein.

* * * * *